US006357555B1

(12) United States Patent
Koza et al.

(10) Patent No.: US 6,357,555 B1
(45) Date of Patent: Mar. 19, 2002

(54) PREWIRED ELEVATOR DOOR FRAME

(75) Inventors: Frank Koza, Falkenthal; Karl-Fredrich Schöps, Berlin, both of (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/568,400

(22) Filed: May 10, 2000

(51) Int. Cl.[7] ..... B66B 7/00
(52) U.S. Cl. ..... 187/413; 52/30
(58) Field of Search ..... 187/413, 414; 52/30, 220.2

(56) References Cited

U.S. PATENT DOCUMENTS 3,707,205 A * 12/1972 Gibson ..... 187/1 R
3,741,351 A * 6/1973 Suozzo ..... 187/95
3,851,736 A * 12/1974 Westlake et al. ..... 187/95
4,266,632 A * 5/1981 Yoneda et al. ..... 187/29 R
4,497,391 A * 2/1985 Mendelsohn et al. ..... 187/29 R
4,529,062 A * 7/1985 Lamprey ..... 187/1 R
4,832,158 A * 5/1989 Farrar ..... 187/103
4,986,040 A * 1/1991 Prewer et al. ..... 52/79.1

FOREIGN PATENT DOCUMENTS

JP 4-39282 * 2/1992 ..... 187/413
JP 4-116074 * 4/1992 ..... 187/413

* cited by examiner

*Primary Examiner*—Thomas J. Brahan
(74) *Attorney, Agent, or Firm*—Carlson, Gaskey & Olds

(57) ABSTRACT

An elevator system includes door frame assemblies that are prewired with the plurality of wires needed to make connections between various components in the elevator system. A door frame assembly preferably includes a plurality of wires bundled within a jacket or sheath that are supported within the door frame assembly. An extension portion of the wires extends outward and away from the door frame assembly. One end of each wire is connected with a single connector portion while the opposite ends are connected with a single socket portion. The connector portion of one door frame assembly is conveniently coupled with the socket portion of an adjacent door frame assembly to complete the necessary connections along the elevator system hoistway.

20 Claims, 1 Drawing Sheet

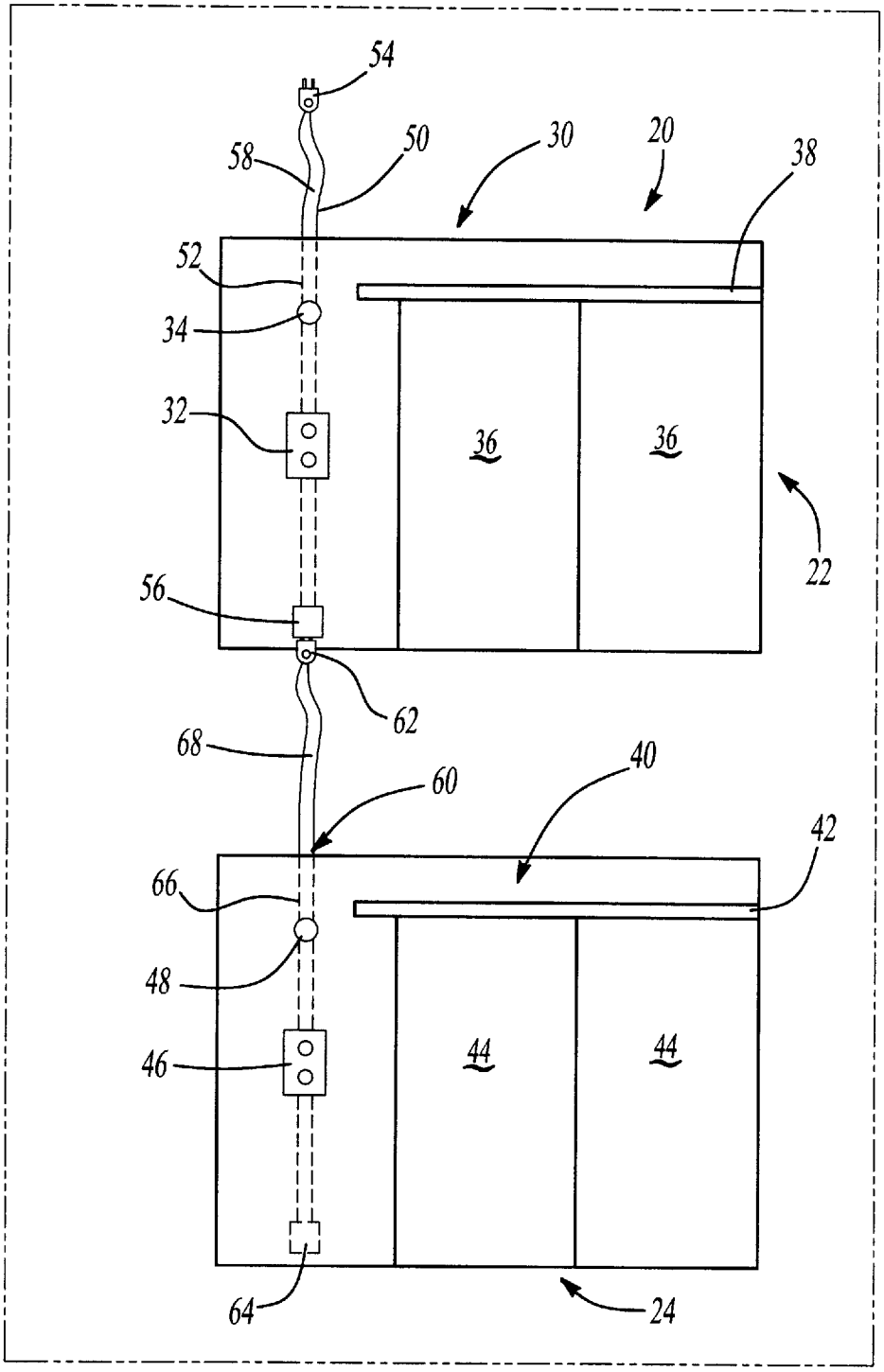
54
58
50
30
20
38
52
34
32
36
36
22
56
62
68
60
40
42
66
48
46
44
44
64
24

PREWIRED ELEVATOR DOOR FRAME

BACKGROUND OF THE INVENTION

This invention generally relates to elevator door frames and, more particularly, to prewired elevator door frames that facilitate more efficient installation.

One challenge associated with installing elevator systems within buildings is wiring the various components of the system together. A plurality of wires are required to communicate power or electrical signals to the various components, such as electronic controllers, hall buttons and lights. Typically, installation includes a significant amount of labor to install the necessary wires and make appropriate connections.

In addition to the amount of time and labor required, the complexity of an installation allows for the possibility that wires are not properly installed. This can include making improper connections or damage to the wires during installation. Obviously, such situations need to be avoided in order to provide a properly operating elevator system upon completing the installation and to minimize future repair costs.

Therefore, there is a need for an improved system and method for installing the necessary wiring for an elevator system. This invention addresses that need.

SUMMARY OF THE INVENTION

In general terms, this invention is an elevator system including a plurality of door frames installed at a plurality of landings along a hoistway. Each of the door frames is prewired. Each door frame includes a plurality of wires supported within the door frame that are preassembled into the door frame before the door frame is installed at the landing. Each door frame includes a connector portion coupled with a first end of the wires. The connector portion has a length that extends away from the door frame. Each door frame also includes a socket portion that is adapted to be coupled to the connector portion of another one of the door frames.

Various features and advantages of this invention will become apparent to those skilled in the art from the following detailed description of the currently preferred embodiment. The drawing that accompanies the detailed description can be briefly described as follows.

BRIEF DESCRIPTION OF THE DRAWING

The figure schematically illustrates an elevator system incorporating an embodiment of this invention.

DETAILED DESCRIPTION OF THE PREFERRED EMBODIMENT

The figure schematically illustrates an elevator system 20 including a first landing 22 and a second landing 24. A door frame assembly is positioned at each landing along a hoistway (not specifically illustrated).

A first door frame assembly 30 is positioned at the first landing 22. The door frame assembly 30 preferably Supports hall buttons 32 and a light 34. Sliding hoistway doors 36 preferably are supported on a guide portion 38 that is part of the door frame assembly 30. The hall buttons 32, light 34 and doors 36 preferably operate in a conventional manner.

A second door frame assembly 40 is positioned at the second landing 24. The door frame assembly 40 includes a guile portion 42 along which the hoistway doors 44 move in a conventional fashion. Hall buttons 46 and a light 48 preferably are also supported by the door frame 40.

The door frame assemblies 30 and 40 are prewired with a plurality of wires that are used to communicate power or electrical signals between various components in the elevator system 20.

The first door frame assembly 30 includes a wire assembly 50 that includes a plurality of wires (not specifically illustrated) within a single sheath or jacket 52. One end of the plurality of wires is connected with a connector portion 54. The opposite end of the wires are appropriately connected with a socket portion 56.

An extension portion 58 extends away from the door flame assembly 30 so that the connector portion 54 is spaced from the remainder of the assembly. The length of the extension portion 58 preferably is sufficient to accommodate the distance between door frame assemblies on different floors of a building, for example. Typical lengths may be ten feet or three meters, for example.

The second door frame assembly 40 includes a wire assembly 60. One end of the wire assembly 60 includes a connector portion 62 with a socket portion 64 at the opposite end, extending away from the door frame assembly 40. The plurality of wires in the wire assembly 60 preferably are bundled within a single sheath or jacket 66. An extension portion 68 of the wire assembly 60 preferably extends outward from the door frame assembly 40 so that the connector portion 62 can be coupled with the socket portion 56 of the first door frame assembly 30.

Having prewired door frame assemblies greatly enhances the efficiency of the installation process. Rather than requiring manual labor for running the plurality of wires through the length of the hoistway and making connections to the various components such as the hall buttons and lights, the door frame assemblies are prewired as schematically illustrated. To the extent possible, it is preferable to prewire individual components such as hall buttons or lights when they are supported by the door frame assemblies. Of course, this invention includes making particular connections to other components of an elevator system as may be required.

Prewired door frame assemblies designed according to this invention allow the door frame assembly to be installed at a desired landing. A single connection can then be made between the connector portion of one door frame assembly and the socket portion of an adjacent door frame assembly (i.e., at the next landing along the hoistway). This is a far more efficient procedure than manually running individual wires through the length of an entire hoistway.

Accordingly, this invention provides an enhanced elevator system and an enhanced method of installing an elevator system. The preceding description is intended to provide an example implementation of this invention, but not to be limiting. Variations and modifications to the disclosed embodiment may become apparent to those skilled in the art that do not necessarily depart from the basis of this invention. The scope of legal protection given to this invention can only be determined by studying the following claims.

What is claimed is:

1. A landing door assembly for use in an elevator system, comprising:

a door frame;

a plurality of wires preset and supported by the door frame;

a connector portion associated with one end of the wires and extending away from the door frame; and a socket portion associated with an opposite end of the wires for engagement with a connector portion of another similar door assembly.

2. The assembly of claim 1, wherein the socket portion is supported on the door frame.

3. The assembly of claim 1, wherein the socket portion is supported a distance from the door frame.

4. The assembly of claim 1, wherein the wires are bundled and disposed within a single sheath.

5. The landing door of claim 1, including at least one component supported by the door frame, the component being electrically coupled to at least one of the wires.

6. The assembly of claim 5, wherein the component comprises a call button.

7. The assembly of claim 1, wherein at least some of the wires extend vertically through the frame.

8. The assembly of claim 1, including a call button supported by the door frame and electrically coupled with at least one of the wires.

9. An elevator system comprising:

a hoistway;

a plurality of elevator landings spaced along the hoistway; and at least one landing door frame at each landing, each landing door frame including:

a plurality of wires supported by the frame, a connector portion coupled with a first end of the wires, the connector portion having a length that extends away from the frame, and a socket portion coupled with a second end of the wires for engagement with the connector portion of another one of the frames.

10. The system of claim 9, wherein the connector portion of a first frame is inserted into the socket portion of a second frame that is located at an adjacent one of the landings.

11. The system of claim 10, wherein each connector portion has a length extending away from each frame and each length is at least as long as a distance between adjacent ones of the frame.

12. The system of claim 9, wherein the plurality of wires are bundled within a single casing and the casing is disposed within the frame.

13. The system of claim 9, including a component predisposed on each landing door, each component being electrically coupled to one of the plurality of wires.

14. The system of claim 13, wherein the component comprises a call button.

15. The system of claim 9, wherein at least some of the wires extend vertically through the frame.

16. The system of claim 9, including at least one call button supported by each door frame, each call button electrically coupled with at least one of the plurality of wires at each frame.

17. A method assembling an elevator system having a plurality of landings disposed along a hoistway with at least one hoistway door frame at each landing, comprising the steps of:

(A) assembling each of the hoistway door frames;

(B) supporting a plurality of wires using each frame;

(C) mounting each door frame at a respective one of the landings subsequent to performing step (B); and (D) coupling the wires supported by each door frame to the wires of an adjacent one of the door frames.

18. The method of claim 17, wherein step (D) includes plugging in a connector portion from each door frame into a socket portion of the corresponding adjacent door frame.

19. The method of claim 17, wherein step B includes mounting a call button to each frame and electrically coupling each call button to at least one wire associated with the corresponding frame.

20. The method of claim 17, including coupling a connector portion with one end of the wires at each door frame and coupling a second end of the wires at each door frame with a socket portion.

* * * * *